United States Patent [19]

Lautenschlager, Jr.

[11] Patent Number: 4,797,972

[45] Date of Patent: Jan. 17, 1989

[54] SHEET METAL INSERT CUP FOR CABINET HINGES HAVING A MORTISE CENTERING MECHANISM

[75] Inventor: Karl Lautenschlager, Jr., Reinheim, Fed. Rep. of Germany

[73] Assignee: Karl Lautenschlager KG Mobelbeschlagfabrik, Reinheim, Fed. Rep. of Germany

[21] Appl. No.: 618,131

[22] Filed: Jun. 7, 1984

[30] Foreign Application Priority Data

Jul. 30, 1983 [DE] Fed. Rep. of Germany ..... 3327673

[51] Int. Cl.[4] ..... E05D 5/02

[52] U.S. Cl. ..... 16/382; 16/DIG. 40; 16/DIG. 43

[58] Field of Search ..... 16/237, 238, 245, 246, 16/249, 282, 288, 294, 302, 370, 382, 384, DIG. 40

[56] References Cited

U.S. PATENT DOCUMENTS 3,439,378 4/1969 Ennis ..... 16/384
4,069,549 1/1978 Zernig et al. ..... 16/384
4,270,240 6/1981 Zernig et al. ..... 16/382 X

FOREIGN PATENT DOCUMENTS 2143672 3/1973 Fed. Rep. of Germany ..... 16/382
2334246 1/1975 Fed. Rep. of Germany ..... 16/384
6615129 5/1967 Netherlands ..... 16/384

*Primary Examiner*—Fred A. Silverberg

[57] ABSTRACT

The insert cup for cabinet hinges is made from stamped and drawn sheet metal and can be sunkenly mounted in a cylindrical mortise in the area adjacent the edge of the inside face of a door leaf. It has a tub- or trough-like portion having on its upper edge a marginal flange which covers the interstice between the tub-like portion and the circumferential wall of the cylindrical mortise and, at least at a sector-shaped portion, lies matingly and flush within the mortise. On the margin of the sector-shaped portion of the flange there are provided integral guiding lugs which are bent downwardly at right angles into the interior of the cylindrical mortise and which center the insert cup in the proper installed position and secure it against displacements in the plane of the door leaf.

4 Claims, 1 Drawing Sheet

SHEET METAL INSERT CUP FOR CABINET HINGES HAVING A MORTISE CENTERING MECHANISM

BACKGROUND OF THE INVENTION

The invention relates to an insert cup which can be fastened within a cylindrical mortise in an area adjacent the edge of the inside face of the door leaf of a cabinet and serves as the door-leaf-related part of a cabinet hinge. It is made by stamping and drawing from sheet metal and has a bathtub-shaped or trough-shaped portion which can be inserted into the cylindrical mortise, and a marginal flange on the upper edge of the trough-shaped portion covering the gap between the trough-shaped portion and the circumferential wall of the cylindrical mortise. In its portion nearer the adjacent edge of the door leaf, the marginal flange has a sector-shaped section fitting flush within the mortise and, in its area more remote from the edge, an affixing section lying on the inside face of the door leaf and overlapping the edge of the mortise, in which at least one hole is provided for a mounting screw that can be driven into the door leaf.

In modern cabinet hinges which are invisible when the door is in the closed position, the door-leaf-related part is almost exclusively in the form of an insert cup which is fastened sunkenly in a mortise, cylindrical as a rule, which is routed or drilled in the back face of the door leaf. When such mortise cups are manufactured from metal by the pressure casting or die casting method, the portion of the cup which is engaged in the mortise is adapted as much as possible to the shape of the mortise, so that after installation it will be in full contact on all sides with the circumferential wall of the mortise, for the purpose of withstanding the stresses on the junction between the mortise cup and the door leaf as a result of the weight of the door, on the one hand, and especially as the result of shocks which occur when the door is swung to the end positions of the hinge. On the other hand, mortise cups made from sheet metal by stamping and drawing cannot, for technical manufacturing reasons and reasons based on the material, be made to fit the shape of the door mortise or mortise in the same complementary fashion. Instead, the portion of these mortise cups that is engaged in the mortise is made in the form of an elongated trough so as to accommodate the hinge links, and only the ends of the trough contact the circumferential wall of the mortise. Between the two long sides of the trough-shaped part and the circumferential wall of the mortise, therefore, gaps remain, which are covered over by a marginal flange on the upper edge of the trough-shaped portion, which fills out the gaps only in its portion adjacent the edge of the door leaf, while the portion remote from the edge reaches beyond the edges of the mortise and lies against the inside surface of the door leaf, thus forming a flange section which can be screwed onto the inside surface of the door leaf with one or two screws. However, due to the lateral free play between the trough-shaped portion of the mortise cup and the mortise wall, the fastening of the flange to the door leaf can become loose, and then the screws themselves loosen all the more rapidly, and soon the danger exists that the door leaf may separate from the insert cup.

In order to prevent this, the insert cups pressed from sheet metal are today, as a rule, provided with plugs of plastic which fill out the intervening space between the trough-shaped portion of the insert cup and the wall of the mortise, but are not visible after the door is assembled, because they are concealed by the marginal flange. The reliable fastening of the insert cups achieved in this manner, however, at least partially annuls the cost advantage over the die-cast insert cups, on account of the expense of manufacturing and installing the plastic plugs.

It is the object of the invention to create an insert cup manufactured by stamping and drawing, which can be in stalled in the door leaf mortise without additional plastic plugs, without thereby diminishing the strength of the attachment of the cup to the door leaf.

THE INVENTION

Setting out from an insert cup of the kind mentioned above, this object is achieved by the invention by providing on the margin of the sector-shaped portion of the marginal flange at least two guiding lugs integrally formed and disposed symmetrically on opposite sides of the longitudinal central plane of the insert cup, and bent at right angles toward the interior of the cylindrical mortise. These guiding lugs lying against the circumferential wall of the recess prevent the occurrence of any possible lateral free play of the trough-shaped portion in the mortise, so that the effect of the formerly required plastic plugs is virtually achieved, without any additional manufacturing cost.

The guiding lugs are best curved to complement the curvature of the circumferential wall of the recess, so as to achieve large-area contact.

If the insert cup is intended for link hinges, such as four-pivot hinges for example, in which the ends of the hinge links are mounted in the cup on pivot pins set in bores in the flattened side walls of the trough-shaped portion, it is desirable to dispose the guiding lugs and shape them such that they will not interfere with the installation of the pivot pins when the hinges are assembled.

DESCRIPTION OF A PREFERRED EMBODIMENT

Figure 1:
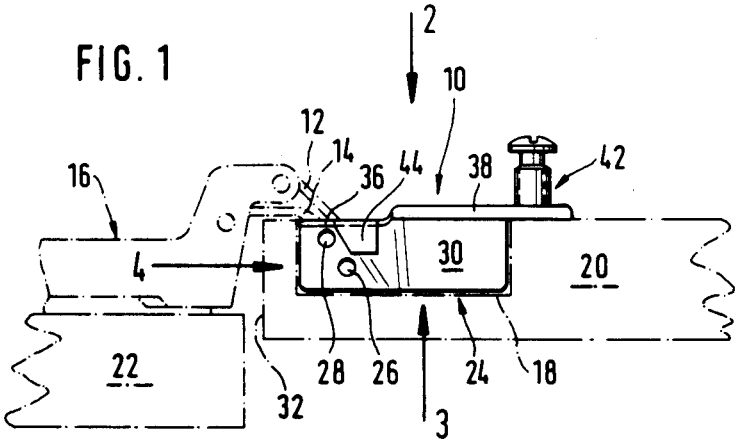
FIG. 1 is a side view of an insert cup made in the manner of the invention and intended for a four-pivot hinge; the hinge linkage and the supporting-wall-related part of the hinge, as well as the supporting wall of the cabinet carcass and the open door leaf of an associated cabinet, are represented only in broken lines.
Figure 2:
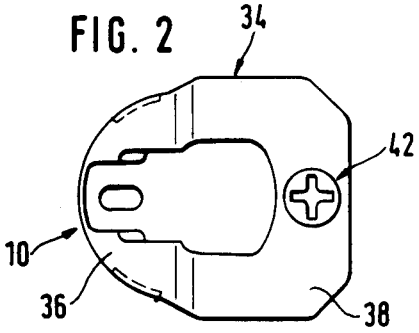
FIG. 2 is a top view of the insert cup, seen in the direction of the arrow 2 in FIG. 1.
Figure 3:
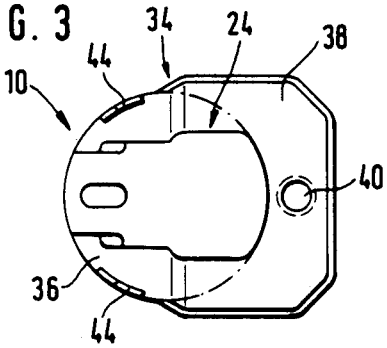
FIG. 3 is a bottom view of the insert cup, seen in the direction of the arrow 3 in FIG. 1.
Figure 4:
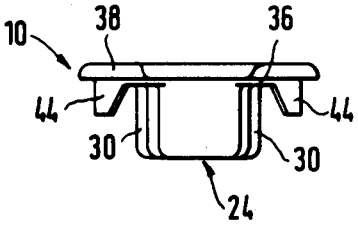
FIG. 4 is a front view of the insert cup, seen in the direction of the arrow 4 in FIG. 1.
Figure 5:
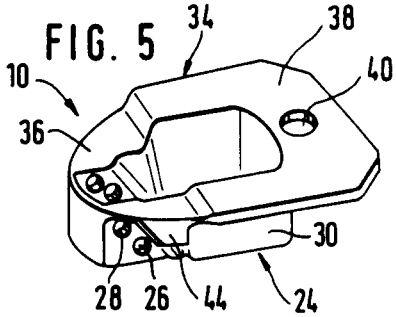
FIG. 5 is a perspective view of the insert cup represented in FIGS. 1 to 4.

The insert cup shown in the drawing, made from sheet metal by the stamping and drawing method, is intended in this particular case for a four-pivot hinge whose hinge links 12 and 14 and supporting-wall-related part in the form of a supporting arm 16 are indicated diagrammatically by broken lines in FIG. 1. The arrangement of the insert cup in a cylindrical mortise 18 in the inside face of a door leaf 20 and the fastening of the supporting arm 16 on the supporting wall 22 of a cabinet carcass are known, and therefore represented only in broken lines.

The insert cup 10 has an elongated tub-like or trough-shaped portion 24 which can be inserted into the mortise 18, and in which the pivot eyes provided on the ends of the hinge links 12 and 14 are mounted on pivot pins whose ends are set in bores 26 and 28 in the side walls 30 of the trough-shaped portion 24. The elongated trough shape of portion 24 is required for the accommodation of the ends of the hinge links 12 and 14 and also of the front end of the supporting arm 16 when the hinge is in the closed state. The length of the trough-shaped portion 24, at right angles to the edge 32 of door leaf 20, is approximately equal to the inside diameter of the mortise 18, so that the insert cup 10 is held in the mortise 18 against displacement in this direction, parallel to the door leaf faces. Between the side walls 30 of portion 24 and the circumferential wall of the mortise 18, however, visible gaps are left which are covered by a marginal flange 34 projecting outwardly at right angles from the upper edge of the trough-shaped portion 24. The marginal flange 34 is composed of two portions 36 and 38, of which the section 36 adjacent the edge 32 lies matingly and flush within the associated mouth of the mortise 18. Therefore it has a sector-shaped configuration of a radius corresponding to the radius of the mortise 18. On the other hand, the section 38 remote from the edge 32 is set slightly higher and considerably enlarged, so that it overreaches the edge of the mortise and lies on the inside face of the door leaf. In the portion lying on the inside face of the door leaf a fastening bore 40 is provided through which a fastening screw 42 can be driven into the door leaf 20 in order to fix the insert cup in its proper position within the mortise 18. Instead of the single fastening bore 40, two fastening bores disposed at a lateral distance from the longitudinal central plane of the insert cup 10 can, of course, be provided.

To secure the insert cup 10 against lateral displacements, i.e., displacement parallel to the edge 32 and parallel to the faces of the door leaf 20, even without the use of plugs, two guiding lugs 44 are formed integrally on the rim of the sector-shaped flange section 36 and symmetrically arranged one on each of the opposite sides of the longitudinal central plane of the insert cup, and they are bent downwardly at right angles, i.e., into the interior of the mortise 18. After the insert cup 10 has been installed in the mortise 18, these guiding lugs engage the circumferential wall of the mortise and thus securely establish the position of the insert cup 10 in the mortise 18. To achieve a large-area engagement between the guiding lugs 44 and the circumferential wall of the mortise 18, the guiding lugs are curved to match the radius of the circumferential wall of the mortise.

In the drawing it can be seen that the guiding lugs 44 are cut at an angle on their edges adjacent the door edge, in order thus to permit access for the installation of the pivot pins in bores 26 and 28 in the side walls 30 of the trough-shaped portion 24.

It is apparent that, within the scope of the invention, modifications and further developments of the above-described insert cup 10 can be realized, which relate especially to the shape of the guiding lugs 44. If the insert cup is intended, not for four-pivot hinges, but, for example, for a crosslink hinge in which the bores for the attachment of the link arms or links are in a different position in the side walls, the external configuration of the guiding lugs can be modified accordingly. It is important only that a lateral guidance of the insert cup in the mortise is achieved and the bores remain accessible for the installation of the pivot pins for the assembly of the hinge.

I claim:

1. An insert cup to be fastened in a substantially cylindrical mortise provided close to an edge in the inside face of a door-leaf of a cabinet, and serving as a door-leaf related part of a cabinet hinge; said insert cup being a stamped and drawn piece of sheet metal having an elongated trough-like part for insertion into the mortise, a marginal flange at an upper edge of the trough-like part, said marginal flange having a sector-shaped flange section to fit matingly and flush within the mortise adjacent the edge, and also having a fastening flange section to lie on said inside face remote from said edge, and at least two guiding lugs integral with said sector-shaped flange section and respectively symmetrically on opposite sides of the longitudinal central plane of the elongated trough-like part, said lugs being bent downwardly from said upper edge at right angles to extend into the interior of the mortise so as to rest against a circumferential wall of the cylindrical mortise and center the insert cup in the mortise and securing the cup against displacements in the plane of the door-leaf.

2. An insert cup according to claim 1, wherein said guiding lugs are curved to complement the circumferential wall of the mortise.

3. An insert cup according to claim 1 wherein said trough-like part has flat sides with bores for the accommodation of pivot pins for hinge links, said guiding lugs being disposed and shaped so as to leave the pivot pin bores uncovered when viewed in a direction perpendicular to the flat sides.

4. An insert cup according to claim 2, wherein said trough-like part has flat sides with bores for the accommodation of pivot pins for hinge links, said guiding lugs being disposed and shaped so as to leave the pivot pin bores uncovered when viewed in a direction perpendicular to the flat sides.

* * * * *